United States Patent [19]

Reynolds

[11] Patent Number: 4,913,007

[45] Date of Patent: Apr. 3, 1990

[54] RIGHT ANGLE EXTENSION TOOL

[76] Inventor: Randall W. Reynolds, 5710 E. 30 Pl., Tulsa, Okla. 74114

[21] Appl. No.: 418,282

[22] Filed: Oct. 6, 1989

Related U.S. Application Data

[63] Continuation-in-part of Ser. No. 309,811, Feb. 2, 1989.

[51] Int. Cl.[4] ..... B25B 17/00

[52] U.S. Cl. ..... 81/57.29; 81/57.27; 81/177.2; 81/177.6

[58] Field of Search ..... 81/57.26–57.29, 81/57.13, 177.6, 177.2

[56] References Cited

U.S. PATENT DOCUMENTS

| | | | |
|---|---|---|---|
| 1,409,554 | 3/1922 | Kitterman | 81/57.28 |
| 2,694,953 | 11/1954 | Williams | 81/57.29 |
| 2,938,415 | 5/1960 | Kostka | 81/57.29 X |
| 4,474,089 | 10/1984 | Scott | 81/57.29 |

FOREIGN PATENT DOCUMENTS

| | | | |
|---|---|---|---|
| 217368 | 6/1924 | United Kingdom | 81/177.6 |

*Primary Examiner*—D. S. Meislin

[57] ABSTRACT

A right angle extension tool is disclosed for interconnection with a socket wrench. The tool includes an elongated cylinder with a shaft disposed therein. The shaft has a socket box connected to a first end for interconnection with a socket wrench, and has a right angle drive mechanism on a second end. A socket pin is connected to a shaft extending from the right angle drive mechanism. The shaft includes one or more mechanisms, such as articulated joints, to permit the extension tool to flex so difficult to reach bolts or the like can be removed or tightened.

6 Claims, 2 Drawing Sheets

RIGHT ANGLE EXTENSION TOOL

BACKGROUND OF THE INVENTION

This Application is a Continuation-In-Part Application of U.S. Ser. No. 309,811, filed Feb. 2, 1989.

1. Field of the Invention

The present invention relates to an extension tool for use with a socket wrench and, more particularly, to such an extension tool that is extendable, flexible and has a rotatable right angle drive.

2. Description of the Prior Art

With the downsizing of the vehicles and thus the decrease in engine compartment area and with the complexity of current engines it is ever more difficult to work on such engines because of the tight confines. Automotive engineers find it ever more difficult to permit mechanics access to components without requiring the use of special tools or even the complete removal of major subcomponents simply to reach a bolt or screw fastener.

Various tools have been found useful in working on such automotive engines, such as socket wrenches with extensions. In certain circumstances an articulated joint may be included adjacent an outer end of the extension to assist in removing/driving a screw or bolt that is off axis, such is the case for removing spark plugs. While these types of extensions are quite useful they do not permit a very wide range of angles of flexure or deflection. To counter this problem of limited angles of deflection, a number of totally flexible drives have been developed. Examples of these types of drives are disclosed in Swiss Patentschrift No. 255,182 and British Pat. No. 217,368. These drives can bend to about 90° of deflection but once past about 45° their ability to transmit sufficient torque without structural failure becomes limited. Right angle drives are disclosed in U.S. Pat. Nos. 2,938,415 and 3,696,694. Another problem with such drives is that the size of the drive portion is large relative to the size of the main shaft; thus, the right angle drive head cannot be used in tight confines.

In certain circumstances where there is a need for an extension tool that is extendable, flexible and which can transmit torque efficiently at 90° of deflection.

SUMMARY OF THE INVENTION

The present invention has been contemplated to overcome the foregoing deficiencies and meet the above-described needs. Specifically, the present invention comprises a right angle extension tool for interconnection with a socket wrench. An elongated cylinder acts as a housing for an internal shaft that has a socket box at one end for the interconnection with the socket wrench. A second end of the shaft includes a right angle drive mechanism which in turn has a socket pin connected thereto. Any desired type of drive mechanism, such as a socket or screwdriver, can be connected to the socket pin for removing or tightening a bolt or screw. The shaft itself can be flexible or it can include at least one device to permit flexibility of the shaft. Thus, the right angle drive permits at least 90° of deflection from the plane of the socket wrench, and the flex device on the shaft permits the extension tool of the present invention to be capable of over 90° deflection. Also, since the shaft can be formed from rigid, strong material, such as hardened steel, and the flex devices can be steel articulated joints, then the extension tool of the present invention is capable of transmitting very high torque forces without structural failure.

DETAILED DESCRIPTION OF THE PREFERRED EMBODIMENTS

Figure 1:
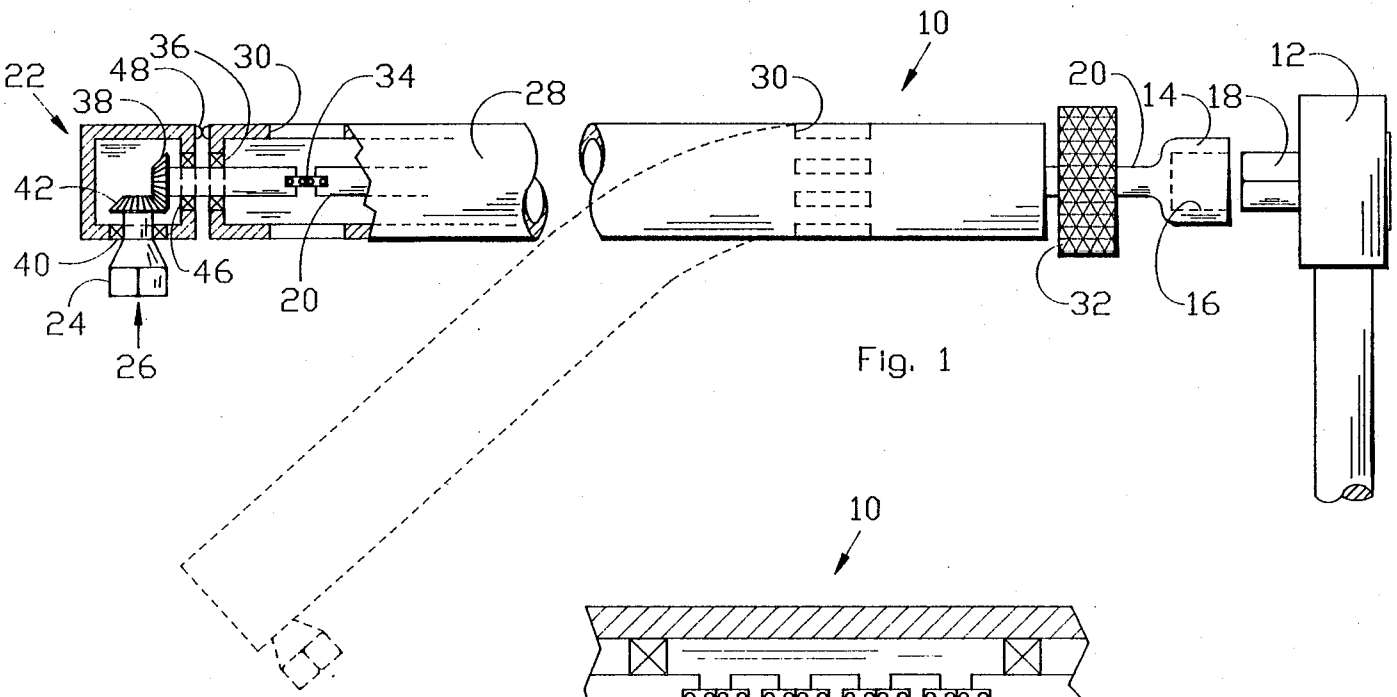
FIG. 1 is a cross-sectional side view of a right angle extension tool of the present invention.

As shown in FIG. 1, a right angle extension tool 10 is shown adapted for interconnection with a rotational drive mechanism, such as a socket wrench 12 or other similar tool. The right angle extension tool 10 has a socket box 14 with an internal opening 16 for receiving a socket pin 18 of the socket wrench 12. The box 14 is formed as part of or is rigidly connected to a first end of a shaft 20 that transmits torque through a rotatable right angle drive mechanism 22, located adjacent a second end of the shaft 20, to an outwardly extending shaft 24. Formed as part of or connected to the shaft 24 is a socket pin 26. Other extension tools or sockets of any desired internal size and configuration can be connected to the socket pin 26. For ease of removal and secure attachment, each socket pin 18 and 26 can be provided with sprung balls and the socket box 16 can include corresponding indentations, as is well known.

The shaft 20 is coaxially disposed within a cylinder 28 from which the first end of the shaft 20 extends. The cylinder 28 provides protection for the shaft 20 and can be made from any desired material, such as rubber, plastic, metal or ceramic material. Further, the cylinder 28 can be provided with spaced openings 30 to permit additional flexibility of the cylinder 28 (as will be described below) or it can be formed from flexible material to permit flexibility.

Figure 2:
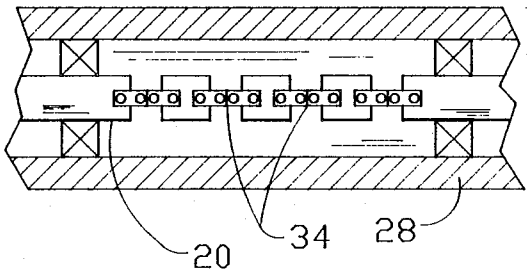
FIG. 2 is a side view of one embodiment of a flex device used within the present invention.

The shaft 20 can include a rigidly connected knob 32 on portion of the shaft 20 between the end of the cylinder 28 and the socket box 14. The knob 32 can be provided with a grooved or knurled surface so that a person's hand can rotate the shaft 20 and thus the socket pin 26 by hand with or without the assistance of the socket wrench 12. To permit flexibility of the shaft 20, at least one mechanism for permitting flexibility is included therein. Such mechanisms can be one or more articulated U-joints 34 or other similar devices. In the embodiment shown in FIG. 1, at least two U-joints 34 are included on the shaft 20 adjacent the openings 30. As shown in FIG. 2, the shaft 20 can be formed from a series of U-joints 34 that extend over essentially the entire length of the cylinder 28 and shaft 20. Usually, the U-joints 34 are formed from hardened steel, as can be the shaft 20, so very large torque forces can be easily transmitted therethrough while providing the desired range of flexibility.

The right angle drive mechanism 22 is housed within a rigid second end portion of the cylinder 28. An end of the shaft 20 passes through a bearing and/or bushing 36 and has a gear 38 attached thereto. The shaft 24 extends through an opening (not shown) on a side portion of the cylinder 28 and passes through a bearing and/or bushing 40. A cooperable gear 42 is connected to the shaft 24; the gears 38 and 42 can be of any desired size or configuration (but are shown as 45° angle bevel gears) as long as the torque from shaft 20 is passed at a 90° (right) angle to the shaft 24.

Because of the flexibility offerred by the U-joints 34 and the ability of the shaft 20 and/or cylinder 28 to flex, the extension tool 10 can be used to remove or tighten bolts and screws at 90° deflection from the socket wrench 12 but permit deflection of greater than 90°, as shown in dotted lines in FIG. 1. Thus, the present invention can be used in very tight places to remove/install bolts and screws that were either unreachable previously or unturnable because of the torque limitations of the previous tools.

Figure 3:
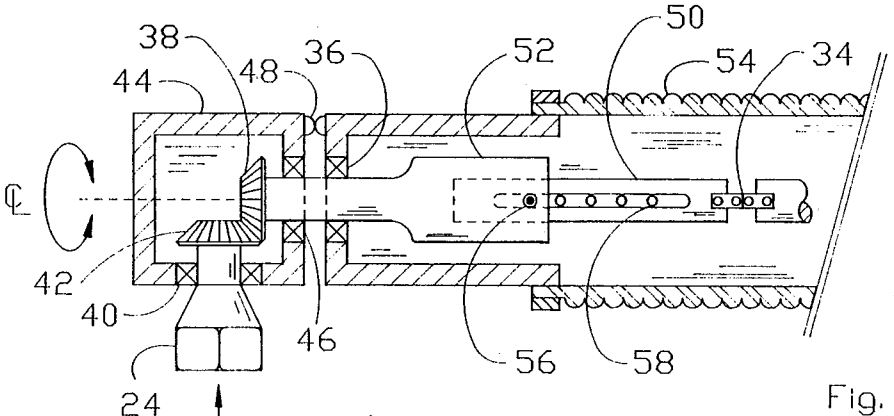
FIG. 3 is a cross-sectional view of a right angle drive mechanism of an extension tool of the present invention.

As shown in FIG. 3 the right angle drive mechanism is contained within a housing 44 that is of the approximate same size and cross-sectional configuration as the cylinder 28. It is preferable that the housing 44 be as small as possible thereby permitting the "working end" of the extension tool to be inserted into the greatest number of tight places. Another important feature is that the housing 44 is journalled for rotation by bearings 46 to a second end of the shaft 20. This permits the housing 44 and the right angle drive mechanism itself to be rotated about the center-line of the shaft but independently from the shaft. This feature is useful for inserting a socket (not shown) mounted to the pin 26 onto a bolt that is hidden from view. Some form of locking mechanism or adjustable drag mechanism 48 can be included on the housing 44 to provide varying amounts of drag so that rotation of the shaft 20 rotates the pin 26 without necessarily rotating the housing 44 as well.

Another feature of the extension tool is that the shaft 20 can be formed from an inner shaft 50 reciprocally received within an outer shaft 52, so that the extension tool can be lengthened or shortened, as is desired. the extendable shafts 50 and 52 should be of a noncircular cross-sectional configuration, such as square, star shaped and the like to prevent rotation of the inner shaft 50 with respect to the outer shaft 52 and to transmit torque from the socket 14 directly to the pin 26. The shafts 50 and 52 can be formed from flexible steel or can be mounted between, ahead of or behind one or more articulated joints 34, as is desired. Further, the cylinder 28 can be included with portions of compressible/expandable covering material 54, such as flexible plastic or rubber, again to protect the shaft 20 and to permit flexure of the extension tool 10. A spring biased ball or pin 56 can be mounted within a cylinder 28 or within the outer shaft 52 and cooperate with detents 58 on the outer shaft 52 or the inner shaft 50 respectively, to provide some degree of drag and restriction on the reciprocal movement of the shafts 50 and 52 so that the extension tool 10 will maintain the desired length until retracted or extended by a person. Further, the interaction of the pin 56 and detents 58 provide a "click" sound and/or vibration, so that the user can know that the extension tool 10 should be set for a certain number of "clicks", which equals a desired length.

Figure 4:
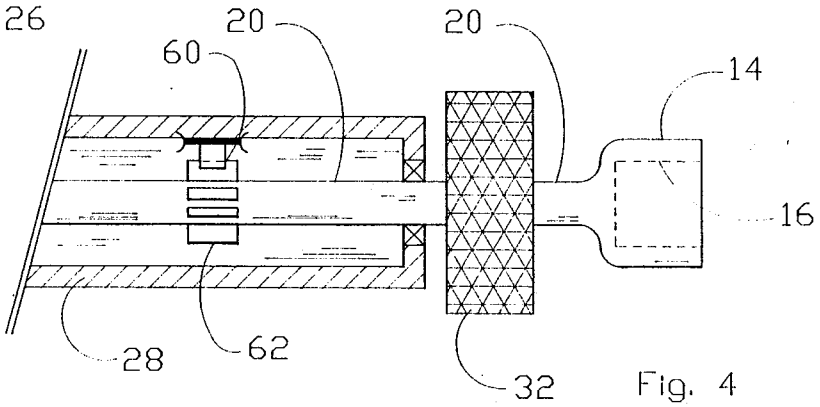
FIG. 4 is a cross-sectional view of a first end portion of an extension tool of the present invention.

As shown in FIG. 4, a first end of the cylinder 28 can include a sprung ball, flexible pin or blade 60 that cooperates with detents or flexible blades 62 on the shaft 20 to create a "clicking mechanism", which provides a vibration as well as an audible indication of increments of rotation of the shaft 20, and thus the pin 26. The blades 60 and 62 assist in preventing the free spinning of the shaft 20 by providing some degree of drag and restriction. Also, the user will know that a certain number of clicks equals a certain number of degrees of rotation, for example, 4 clicks equals a quarter turn and 16 clicks equals a complete 360° rotation of the pin 26.

Wherein the present invention has been described in particular relation to the drawings attached hereto, it should be understood that other and further modifications, apart from those shown or suggested herein, may be made within the scope and spirit of the present invention.

What is claimed is:

1. A right angle extension tool for interconnection with a socket wrench, comprising:

an elongated cylinder including means for permitting flexure thereof;

a shaft disposed within the elongated cylinder and having a first end extending out from the elongated cylinder, the shaft including means for permitting flexure thereof;

wherein at least one portion of the flexible elongated cylinder includes means for permitting compression and expansion thereof, and the shaft comprises an inner shaft reciprocally received within an outer shaft to permit longitudinal extension thereof;

a socket box connected to the first end of the shaft for interconnection with a socket wrench;

right angle drive means connected to a second end of the shaft independently from the shaft; and a socket pin connected to an outwardly extending shaft of the right angle drive means.

2. A right angle extension tool of claim 1 wherein the means for permitting flexure of the shaft comprises at least one articulated joint.

3. A right angle extension tool of claim 1 wherein the right angle drive means comprises a right angle beveled gear drive housed within a gear housing journalled to the second end of the shaft.

4. A right angle extension tool of claim 1 wherein the shaft and the cylinder include means for yieldably restraining the inner and the outer shafts from reciprocal movement thereof and for providing indication of increments of extension.

5. A right angle extension tool of claim 1 wherein the shaft includes a coaxial knob adjacent the first end thereof permitting direct hand rotation of the shaft.

6. A right angle extension tool of claim 1 including means connected to the cylinder for yieldably restraining the shaft from rotation and for providing indication of increments of rotation.

* * * * *